United States Patent [19]

Paramythioti et al.

[11] 4,330,738

[45] May 18, 1982

[54] METHOD AND APPARATUS FOR CONTROLLING THE FREQUENCY OF VIBRATION IMPARTED TO THE GROUND BY A COMPACTING MACHINE

[75] Inventors: Michel Paramythioti, Lamorlaye; François Degraeve, Pont Sainte-Maxence, both of France

[73] Assignee: Albaret S.A., Rantigny, France

[21] Appl. No.: 46,048

[22] Filed: Jun. 6, 1979

Related U.S. Application Data

[63] Continuation-in-part of Ser. No. 902,219, May 2, 1978, abandoned.

[30] Foreign Application Priority Data

May 9, 1977 [FR] France ..... 77 14043

[51] Int. Cl.³ ..... B64C 17/02

[52] U.S. Cl. ..... 318/128; 318/608; 318/648; 335/297; 404/117

[58] Field of Search ..... 404/117, 84; 318/648, 318/460, 607, 608, 587, 561, 114, 127, 128; 74/87; 324/83 A, 83 R, 207; 335/297

[56] References Cited

U.S. PATENT DOCUMENTS

| | | | |
|---|---|---|---|
| 3,053,157 | 9/1962 | Martin | 404/117 X |
| 3,250,983 | 5/1966 | Atkinson | 318/587 X |
| 3,477,280 | 11/1969 | Blackmer | 324/207 |
| 3,514,719 | 5/1970 | Rhodes | 318/616 X |
| 3,797,954 | 3/1974 | Harris | 404/117 |
| 3,842,379 | 10/1974 | Barnett | 335/297 |
| 3,858,170 | 12/1974 | Freeman | 324/834 X |

*Primary Examiner*—B. Dobeck

*Attorney, Agent, or Firm*—Charles E. Brown

[57] ABSTRACT

Apparatus for controlling the frequency of vibrations imparted by the vibrating element of a compacting machine to the ground which comprises a vibration pick-up responsive to the amplitude of vibrations of a mass composed of the vibrating element and the ground being vibrated which produces a vibration signal; a position sensor sensing the angular position of an eccentrically loaded rotary shaft on which the vibrating element is mounted, which produces a position signal; and a phasemeter which receives the vibration and position signals and provides an output signal related to the phase difference therebetween. This phase difference may be displayed in which case the motor for the rotary shaft can be controlled manually in accordance therewith or it may be fed to an automatic control system in which it is compared with a set signal to produce an error signal for automatically regulating the speed of motor turning the rotary shaft. Preferably the vibration pick-up and position sensor are of identical constructions and processed by identical band pass filters.

16 Claims, 15 Drawing Figures

METHOD AND APPARATUS FOR CONTROLLING THE FREQUENCY OF VIBRATION IMPARTED TO THE GROUND BY A COMPACTING MACHINE

CROSS REFERENCE TO RELATED APPLICATION

This application is a continuation-in-part application of our application Ser. No. 902,219 filed May 2, 1978 now abandoned.

The present invention relates generally to compacting or consolidating ground with a compacting machine, by the application of local vibrations by means of a vibrating element on the machine, and more particularly to apparatus in which the vibrating element, whether it is a plate or a roller, is subjected to vibrations produced by an eccentrically loaded rotary shaft.

It is well known, and tests have confirmed, that a particular ground in a particular condition subjected to vibrations applied a vibrating element reacts to the impacting of the vibrating element so that the amplitude of displacements of particles of the ground varies as a function of the impacting frequency, and as a function of the physical characteristics of the vibrating element which is the impacting source.

In practice, the amplitude of displacement reaches a maximum value for a predetermined impacting frequency, called the resonant frequency, which depends on the ground and especially the damping capacity characterizing the same.

Tests have shown moreover that the compacting efficiency of a compacting machine depends on the impacting frequency thereof and it would therefore be interesting to be able to regulate the impacting frequency as a function of the resonant frequency of the ground.

Yet the resonant frequency varies according to the ground and even for a given ground accordig to the degree of compaction or consolidation thereof.

It would therefore presumably be difficult to relate the impacting frequency to the resonant frequency.

An object of the present invention is to provide a method and apparatus which permit the control of the impacting frequency in accordance with the ground being consolidated. Another object of the invention consists in a compacting machine incorporating such an apparatus.

The present invention is based on the discovery that the compacting of ground with vibrations is governed by the laws of physics in respect to wave phenomena and, in addition, to the presence of one or more resonant frequencies there is a constant phase difference or lag between the cause and effect, namely, an impacting force which is the source of vibrations and the amplitude of the vibrations of the ground.

The invention is also based on the complementary finding that there is a direct relationship between the amplitude of the vibrations for a given frequency and the phase difference at the same frequency.

It is contemplated according to the invention to put this direct relationship between amplitude and phase difference to use, i.e., in practice, the impacting frequency as a function of the phase difference, which is suitably picked up.

More specifically, according to the invention there is provided a method for controlling the frequency of vibrations applied by the vibrating element of a compacting machine and produced by an eccentrically loaded rotary shaft, comprising picking up a vibration signal related to the vibrations of the combined vibrating mass composed of the vibrating element and the grounded being vibrated simultaneously with a signal related to the angular position of the rotary shaft, this position being directly related to the impacting force, determining the phase difference between these signals and controlling the rotational speed of the shaft as a function of the phase difference.

It is thus advantageously possible to provide frequency regulation without even knowing particular resonant frequency of the ground being compacted and therefore very easily improve the efficiency of compaction.

Adjustment to obtain the desired frequency may obviously be carried out manually by regulating the control member of a motor driving the rotary shaft.

It may also be performed automatically with an automatic control circuit for controlling a control member, including a comparator which receives a signal related to the measured a comparator which receives a signal related to the measured phase difference and a set signal, the comparator being adapted to produce an error signal related to the difference between its input signals and control the control member in accordance therewith.

The features and advantages of the invention will be brought out in the direction which follows, given by way of example, with reference to the accompanying schematic drawings, in which.

Figure 1:
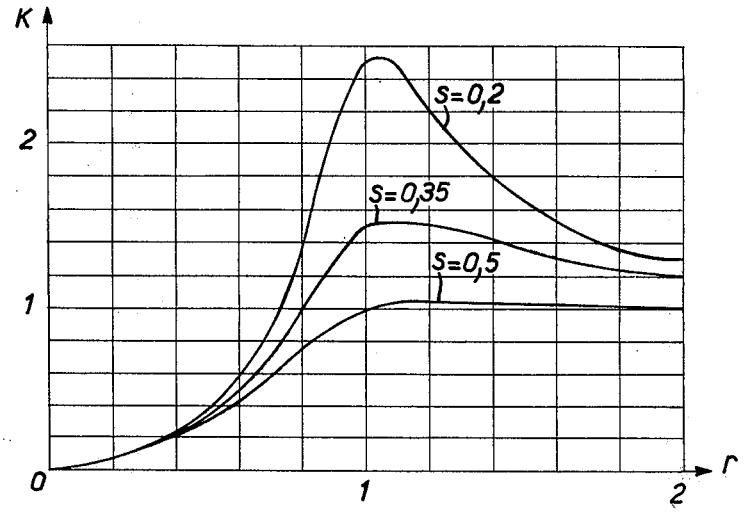
FIGS. 1 and 2 are graphs relating to the compaction of ground with a vibrating element.

On the abscissa of the graph shown in FIG. 1 is marked the ratio r which is defined by the following expression:

$r=\omega/\omega_\eta$ in which $\omega$ is the impacting frequency of the vibrating element against the ground and $\omega_\eta$ is the reference resonant frequency.

The coefficient K is marked along the ordinate axis which is the amplitude of vibrations of the vibrating mass composed of the vibrating element and the ground it vibrates times the impacting frequency, over a theoretical reference amplitude defined by the characteristics specific to the vibrating element.

The different curves correspond to grounds having different damping capacities s, as indicated.

The aforementioned reference resonant frequency $\omega_\eta$ corresponds to a ground having a damping capacity of zero.

For all other types of ground the representative curve of the multiplier coefficient K of the amplitude passes through a maximum for a given resonant impact frequency which shifts farther to the right with respect to the reference resonant frequency as the damping capacity increases.

Figure 2:
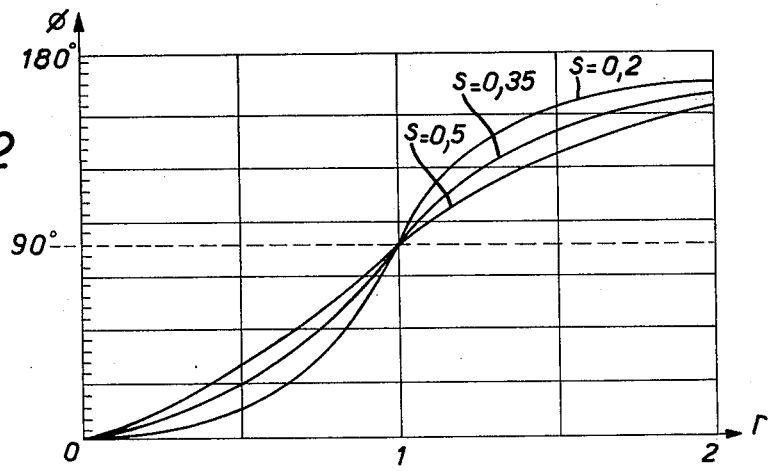

On the graph of FIG. 2 the ratio r defined above is marked along the abscissa and the phase difference $\phi$ between the amplitude of the vibrations of the vibrating mass composed of the vibrating element and the ground vibrated thereby and the impacting force producing the vibrations which the vibrating element transmits to the ground.

As above, the several curves correspond to grounds having different damping capacities; they all pass through the same point when the impacting frequency is equal to the reference resonant frequency $\omega_\eta$ defined above, the phase difference is 90°.

By comparing the graphs of FIGS. 1 and 2 it is seen that there is a direct relationship between the amplitude at a given frequency of vibrations of the vibrating mass composed of the vibrating element and the ground vibrated thereby and the phase difference between the vibrations and the impacting force which is the source thereof.

The present invention is based on this finding.

Figure 3:
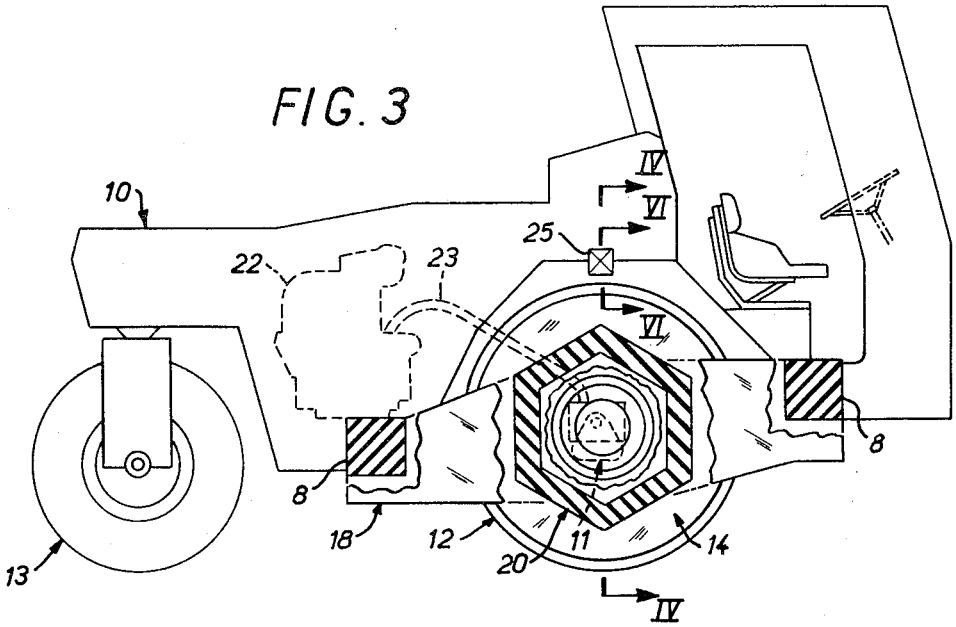
FIG. 3 is an elevational view, partly cutaway, of a compacting machine equipped with apparatus embodying the present invention.

FIG. 3 illustrates, by way of example, a compacting or consolidating machine embodying the present invention.

The compacting machine is well known per se and since its various details are not relied upon for patentability it will not be described herein in great detail. By way of example it should be noted that a compacting machine such as the SISMOPACTOR compacter sold by the assignee of the present application is perfectly suitable.

The compacting machine illustrated comprises a body 10 which is supported on the ground by a pair of rollers 12 which are the vibrating elements described hereinafter and a steered wheel 13.

Figure 4:
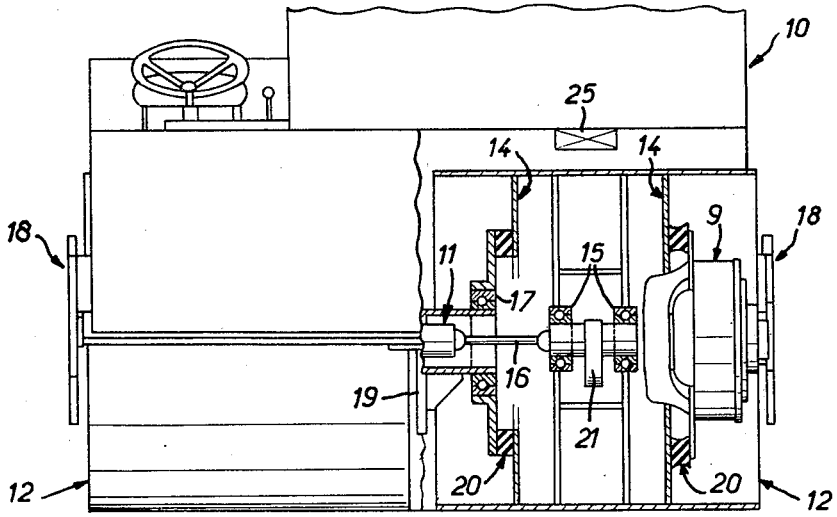
FIG. 4 is in part a transverse sectional view on a different scale, taken along the line IV—IV in FIG. 3 and in part a side view of the compacting machine.
Figure 5:
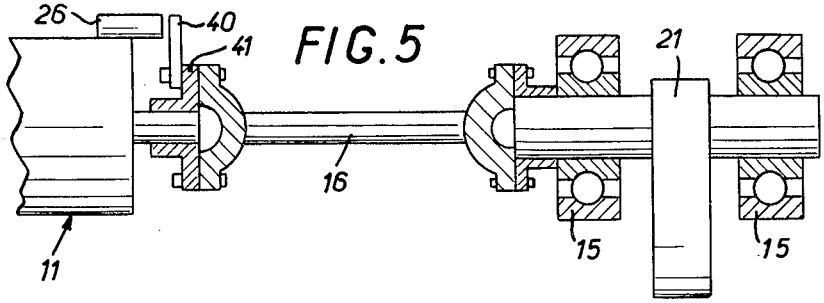
FIG. 5 is a fragmentary view, on an enlarged scale, of the apparatus shown in FIG. 4.

As seen in FIG. 4 the rollers 12 are arranged inside a frame made up of two side beams 18 and a central beam 19 between the rollers; the frame is connected to the body 10 by shock absorbers 8, e.g., solid rubber blocks, interposed between the side beams and the body.

The rollers 12 support the frame by inner webs 14 through other shock-absorbing members 20, also formed as solid rubber blocks for example. The web 14 is fixed by shock-absorbing member 20 to a rotor of a hydraulic motor 9 the stator of which is carried by a corresponding side beam 18, which rotor is thus adapted to drive the roller 12 whereas the other web 14 is fixed by another shock-absorbing member 20 fast with an annular flange centered by the bearing 17 on a ring carried by the central beam 19.

The central beam 19 also supports a motor 11; at the output shaft of the motor is keyed a rotary shaft 16 for each roller 12; the rotary shaft 16 is eccentrically loaded and comprises an eccentric weight 21 between two bearings 15.

As schematically illustrated in FIGS. 3 and 4 the motor 11 is a hydraulic motor which is supplied through a line 23 by a pump driven by a mechanical motor 22; two other pumps driven by the same motor supply the motors 9 driving the rollers 12.

According to the invention the compacting machine is equipped with apparatus for adjusting the frequency of the vibrations which the vibrating element 12 imparts to the ground.

Figure 7:
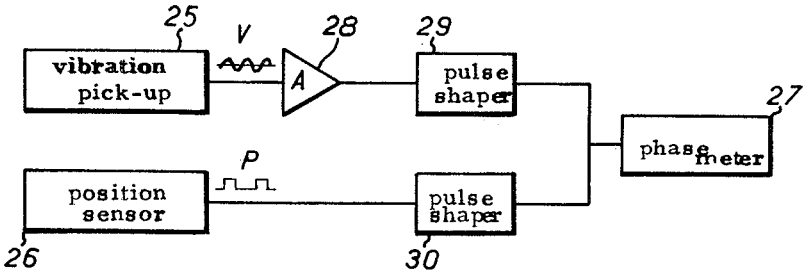
FIG. 7 is a block diagram of an apparatus embodying the invention.

In general, as illustrated in FIG. 7, the apparatus comprises a vibration pick-up 25 responsive to vibrations of the mass composed of the vibrating element 12 and the ground vibrated thereby and adapted to deliver a periodic signal V which is a function of the vibrations, a position sensor 26 responsive to the angular position of rotary shaft 16 or more particularly that of the eccentric weight 21 on the rotary shaft 16 and adapted to deliver a periodic position signal P which is an indication of the position which is directly related to the position of the impacting force, and a phasemeter 27 which receives both the vibration signal and the position signal and measures the phase difference therebetween.

In practice there is provided an amplifier 28 and a pulse shaper 29 between the vibration pick-up 25 and the phasemeter 27 and only a pulse shaper 30 between the position sensor 26 and the phasemeter 27.

Figure 6:
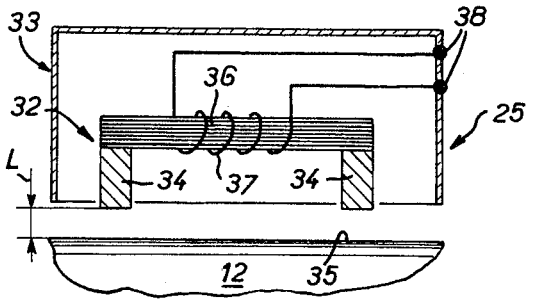
FIG. 6 is a sectional view on a different scale of vibration sensing means of the apparatus embodying the present invention, taken along line VI—VI in FIG. 3.

In the embodiment illustrated in FIGS. 3, 4 and 6, the vibration pick-up 25 comprises a U-shaped magnetic circuit 32 carried by the body 10 of the compacting machine, that is, by a member which is mounted rigidly on the body. The magnetic circuit 32 is, for example, shielded by a protective cover 33, as illustrated. The vibration pick-up 25 further comprises a marker armature 35 of magnetic material which is carried by the vibrating element, which is the roller 12, opposite the free ends of the leg portions 34 of the U-shaped magnetic circuit 32.

In practice and as illustrated, the marker armature 35 may comprise a hoop or band disposed on the outer surface of the roller 12, so that the vibration pick-up is disposed opposite the hoop or band.

In practice too, the intermediate portion 36 of the magnetic circuit 32 comprises a stack of mild iron discs and the leg portions 34 each comprises permanent magnets. A coil 37 is wound around the intermediate portion 36 and the vibration signal V is picked up at the terminals 38 of the coil 37.

In fact, during the compaction of the ground the distance L which comprises an air gap between the leg portions 34 of the magnetic circuit 32 and the armature 35 varies periodically (FIG. 6); a potential difference proportional to the speed of displacement of the armature 35 appears at the terminals 38 of the coil 37. It is therefore a speed signal at this point.

The speed signal may be used directly because it is out of phase by a constant value of 90° with respect to the theoretically desired displacement signal. However, the speed signal is preferably integrated in order to obtain the sought-after displacement signal which permits the reduction of the influence of possible high frequency parasites.

Concurrently, in the embodiment illustrated in FIG. 6, the position sensor 26 is a proximity sensor which uses any reference point fixed for rotation with the rotary shaft 16 and is responsive to the movement of the reference mark facing it.

In the illustrated embodiment the position sensor 26 is carried by the motor 11 which drives the rotary shaft 16 for one of the rollers 12 and the reference mark 40 projects axially from the collar 41 fixed for rotation with shaft 16.

It may be, for example, one of the screws fixing the universal joint for the shaft 16.

The proximity sensor which constitutes the position sensor 26 is of a known construction and its details are not part of the present invention and therefore need not be described in detail herein. It is sufficient to point out that as diagrammatically shown in FIG. 7 the position sensor 26 delivers a position signal P which each time the marker passes provides a pulse.

After suitable shaping in the pulse shapers 29 and 30 the phase difference between vibration signal V and the position signal P is measured in the phasemeter 27. The measured phase difference may be merely displayed as the phasemeter 27 comprises display means known per se (not illustrated).

The control member of the drive motor 22 may then be controlled manually as a function of the phase difference measured.

Figure 8:
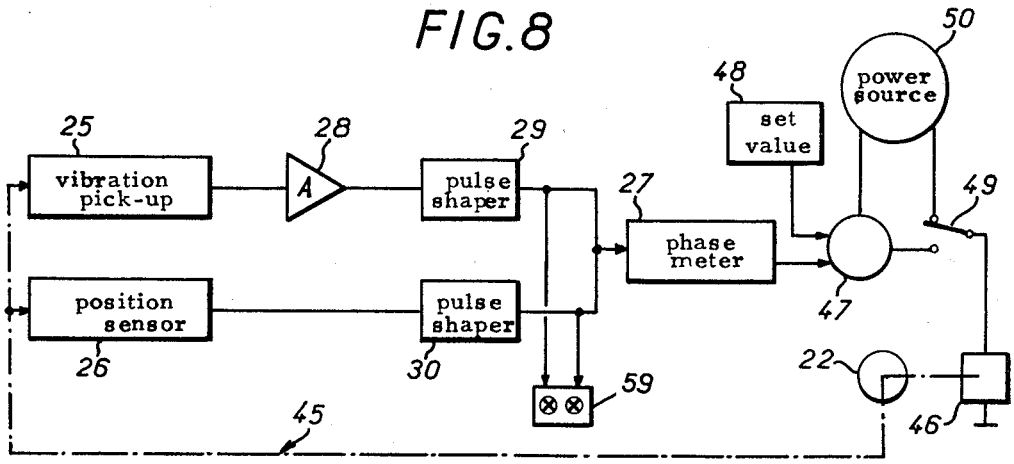
FIG. 8 is a view similar to that of FIG. 7 for an alternative embodiment.

In the alternative embodiment of FIG. 8 for automatically controlling the control member, the apparatus is provided with an automatic control circuit 45 acting on the control member 46 of the drive member 22 from a comparator 47 which receives signals from the phasemeter 27 related to the measured phase difference and a set signal set by potentiometer 48, the comparator 47 being adapted to provide an error signal related to the difference between its two input signals. Preferably an inverter switch 49 is interposed between the comparator 47 and the control member 46 which either permits manual control of the control member 46 by a voltage source 50 or automatic control by means of the comparator 47. The components of the circuits just described are conventional and thus will not be described herein.

Figure 9:
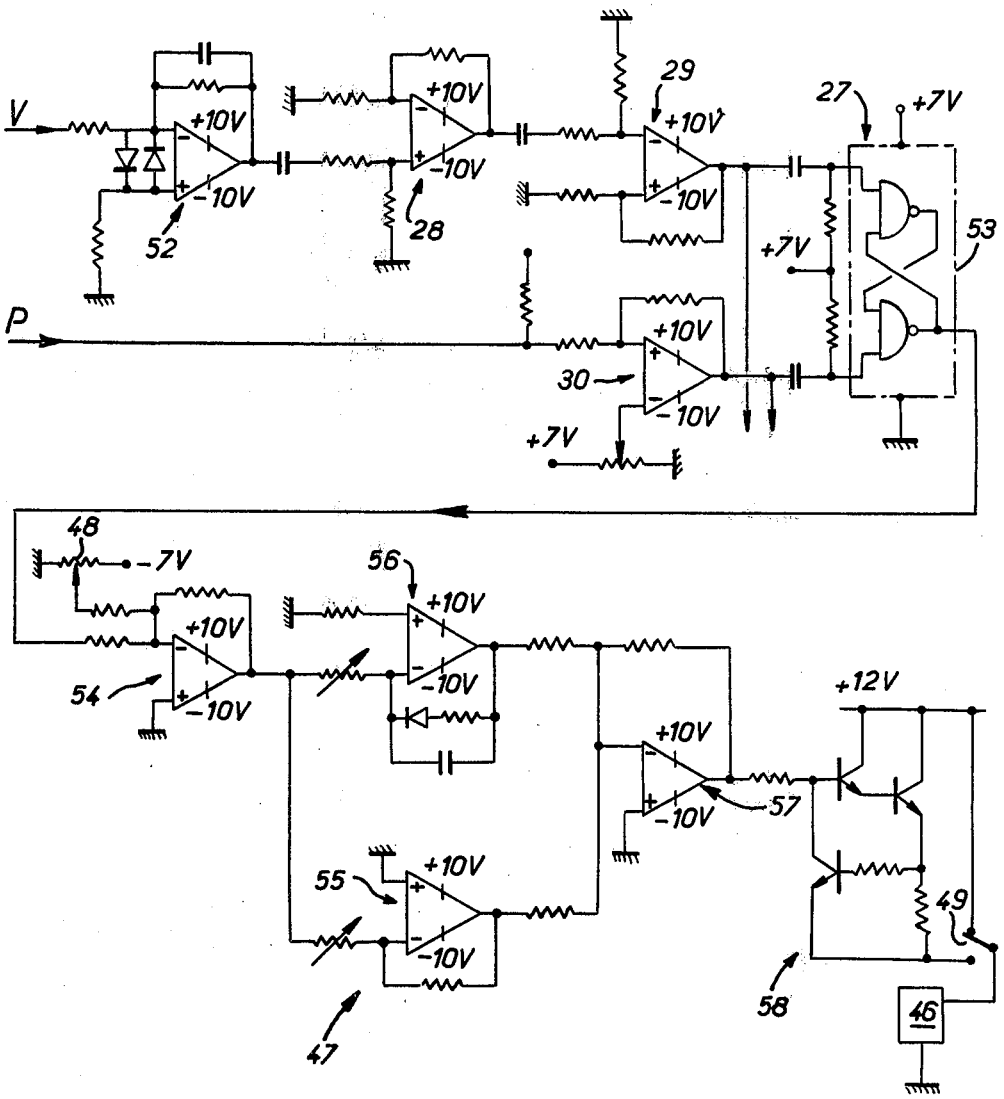
FIG. 9 is a detailed circuit diagram of the modified embodiment of the apparatus schematically illustrated in FIG. 8.

A brief description will now follow with reference to the circuit diagram of FIG. 9 in which the same elements bear the same references as above.

In this alternative embodiment, for reasons which will be brought out hereinafter, the vibration signal V is integrated in integrator 52 before amplification in amplifier 28, the integrator being an operational amplifier operating as an integrator.

The amplifier 28 delivers AC voltage signals to amplifier 29 via capacitor 28*a*. The (−) input of amplifier 29 is positive or negative depending on the direction of the passage through zero. The amplifier 29 is a Schmidt trigger which delivers a high level output signal only when a positive pulse is delivered by the amplifier through the aforesaid capacitor 28*a*. The capacitor 29*a* at the output side of amplifier 29 converts the high level signals into pulses which are supplied to the phasemeter 27. The phasemeter 27 thus receives pulses each time the signal V passes with a positive slope through zero, that is, once during each period of rotation of the roller. The amplifier 30 delivers through a capacitor a positive pulse to the other input of the phasemeter 27 when the eccentric weight is in its uppermost position.

The bistable device 53 is in its high state when the amplifier 30 delivers a pulse and in its low state when the amplifier 29 delivers a pulse. The periods of these operations are obviously inversely proportional to the vibration frequency and the portion of the period during which the bistable device 53 is in its high state is proportional to the phase angle between the eccentric weight position and the roller movement. The average period value of the output of the bistable 53 thus corresponds to this phase angle.

In the illustrated embodiment the element 48 which permits the display of the set value is a potentiometer. The reference voltage set by the potentiometer cursor is added to the voltage output of the phasemeter 27 at the input of the amplifier 54 connected to the input of the comparator 47.

In the illustrated embodiment the output voltage of the amplifier 54 which is related to the difference between the measured phase difference and the set phase difference is amplified in amplifier 55 and integrated in operational amplifier 56. The amplified and integrated signals are then added at the input of output amplifier 57; these added signals may be weighted in order to ensure the overall stability of the apparatus.

The signal delivered by the output amplifier 57 is carried, in the illustrated embodiment, to a power amplifier 58 before being applied via inverter switch 49 to means 46 for controlling motor 22.

In case of a hydraulic motor the control means may be a servo valve for controlling the inlet flow rate of hydraulic fluid delivered by the associated hydraulic pump (not shown).

Obviously other components may be provided, namely means for supplying suitable voltages compatible with the rest of the components of the apparatus.

Further, as illustrated in FIG. 8, means 59 for sensing a possible error in frequency may be provided.

For the measurement of the phase difference to be correct the vibration signal V and the position signal P delivered to the pick-up 25 and the sensor 26 respectively must be mutually coherent. Such means 59, which may be provided with lamps for this reason, permit the signaling of a possible frequency error due to the sensor 25, the pick-up 26 or the shield therefor.

Reference will now be made to FIGS. 10, 10A, 11–13 wherein a further alternative embodiment of the invention is illustrated.

Figure 11:
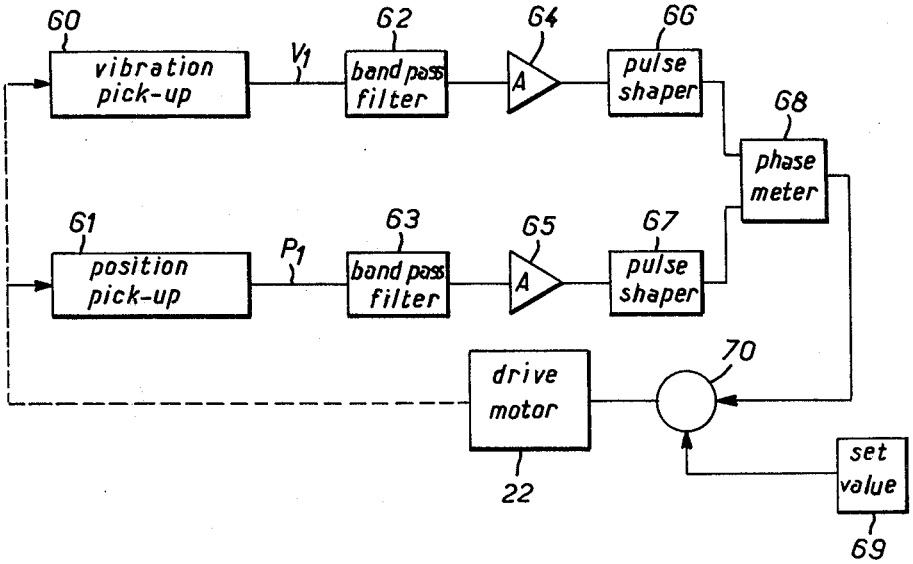
FIG. 11 shows a block diagram for an alternative embodiment of the apparatus.

In the block diagram of FIG. 11 is shown an automatic control system for controlling the frequency of vibrations imparted by the vibrating element of the compacting machine to the ground. This embodiment differs from the embodiments of FIGS. 7–9 essentially in two respects: first the construction of the position and vibration sensing means which in the previous embodiments were fundamentally different from each other whereas they are of substantially the same construction in the instant embodiment; and secondly the use of a band pass filter in each of the vibration sensing and position sensing lines of the control circuit of identical construction instead of the dissilimar circuit of the vibration sensing signal and position sensing signal lines in the FIGS. 7–9 embodiments owing to the different nature of the output signals V (sinusoidal) and P (square wave) of the vibration sensing means and the position sensing means respectively.

The use of band pass filters of identical construction is highly advantageous as any possible phase shift inherent in their construction will be imparted to both lines of the circuit and therefore will be effectively cancelled out in the final comparison. Furthermore the band pass filters permit the suppression of low frequency parasites due to more or less erratic movements of the band or hoop 35 on the roller 12 relative to the chassis 10 (FIG. 6) or even those of an eccentric disc 78 (see FIG. 10) provided in association with the position sensing means. Also, the band pass filters 62 and 63 suppress the parasites due to the stray electrical or magnetic field lines at the pick-ups comprised by the position and vibration sensing means 60 and 61.

Figure 6A:
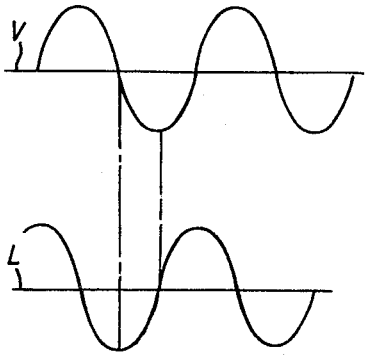
FIG. 6A shows curves of the variation of the distance between the vibration pick-up and the hoop on the roller in FIG. 6, and the output voltage at the terminals of the vibration pick-up.

As shown in FIG. 11 band pass filters 62 and 63 are respectively connected to the output terminals of vibration sensing means 60 and position sensing means 61. The vibration sensing means 60 comprises a vibration pick-up 25 as illustrated in FIG. 6 and described in detail hereinabove. The vibration pick-up 60 likewise comprises a U-shaped magnetic circuit 32 with a coil 37 wound around its intermediate portion 36 formed of discs of mild steel with magnetic leg portions 34 at the ends thereof. This pick-up corresponding to vibration sensing means 60 provides a vibration signal $V_1$ which lags the curve of the sine wave described by the variation in the distance L of the hoop 35 on the roller 12 relative to the pick-up by 90° (see FIG. 6A).

Figure 10:
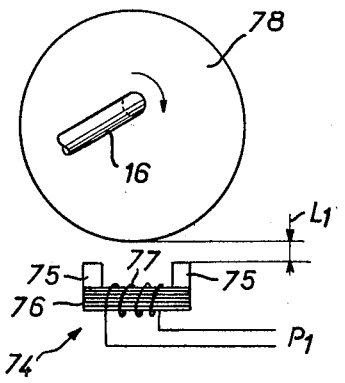
FIG. 10 shows a position pick-up and FIG. 10A which is similar to FIG. 6A shows similar curves for the position pick-up.
Figure 12:
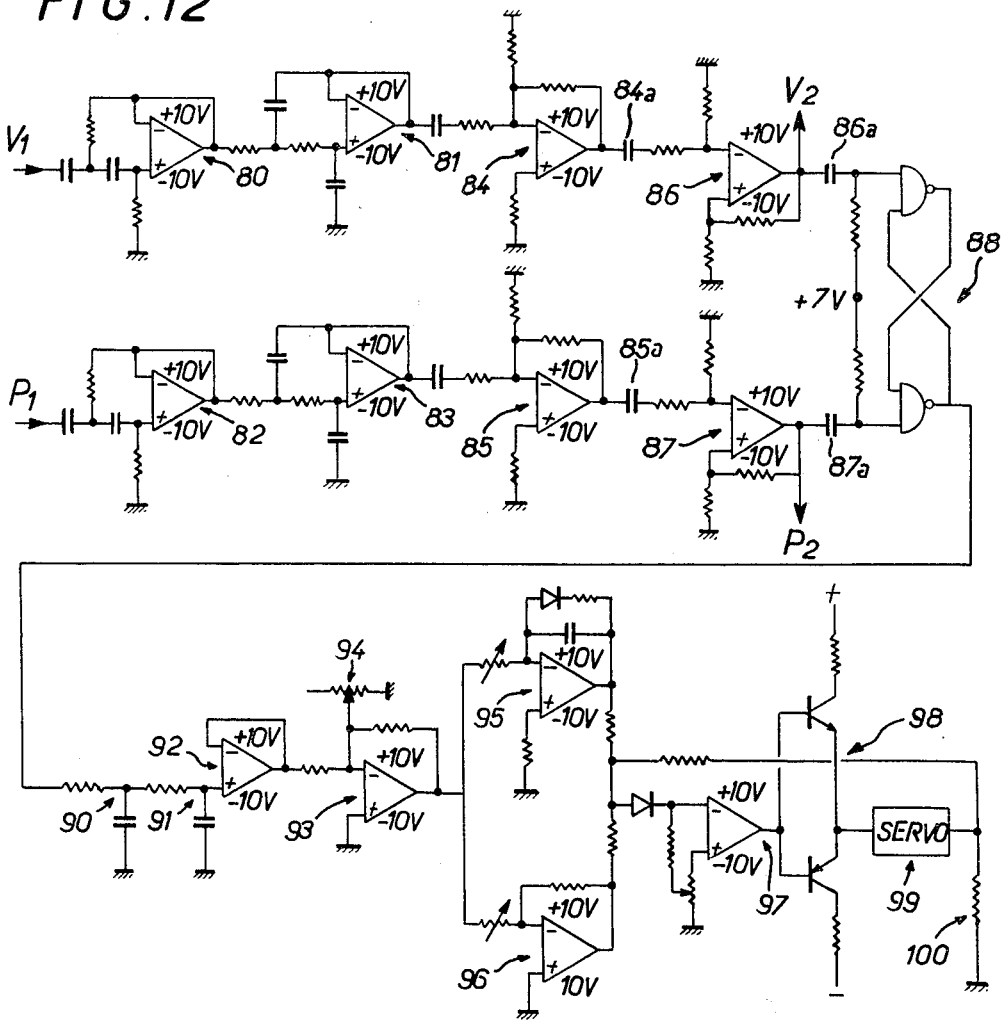
FIG. 12 is a circuit diagram corresponding to the alternative embodiment of FIG. 11.

Instead of the position sensor 26 of the embodiments of FIGS. 7–9 there is provided in the embodiment of FIGS. 10–12 a proximity sensor comprising a position sensing means 61 including a U-shaped magnetic circuit 74 (FIG. 10) of substantially the same construction as magnetic circuit 32 in FIG. 6, comprising a pair of spaced permanent magnetic leg portions 75 disposed at the ends of a stack of mild iron discs 76. A coil 77 is wound around the intermediate portion of the magnetic circuit defined by the stack of discs 76. The leg portions 75 are in position sensing relation facing the edge of the eccentric disc 78 which is adapted to be fixed to the shaft 16 for rotation therewith, for example, on collar 41. Alternatively, the eccentric weight 21 itself may serve as the eccentric disc with the position sensing means 61 facing the edge thereof.

Figure 10A:
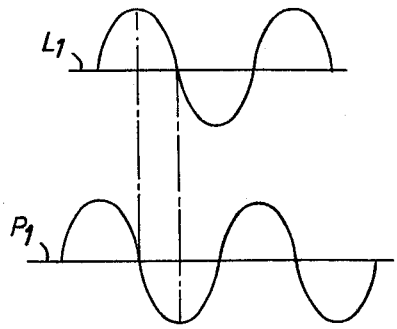

The position sensing means provides a signal $P_1$ (see FIG. 10A) which varies sinusoidally as the distance $L_1$ between the edge of the eccentric disc 78 or eccentric weight 21, as the case may be, and the position sensing means 61 varies. The other curve in FIG. 10A plots the change of the distance $L_1$. The position signal curve $P_1$ leads the distance curve $L_1$ by 90°.

As shown in FIG. 11 the band pass filters 62 and 63 are connected to respective amplifiers 64 and 65 which are in turn connected to respective pulse shapers 66 and 67. Accordingly the position signal line and the vibration signal line of the circuit are thus identical for all purposes, as will be seen in greater detail with respect to the circuit diagram of FIG. 12. The phase difference between the signals is measured in phasemeter 68. The resulting phase difference is compared with a reference phase difference set value 69 and the resulting difference operates a servo control 70 connected to drive motor 22.

Needless to say, the arrangement including the pick-ups 60, 61, band pass filters 62, 63, amplifiers 64, 65, pulse shapers 66, 67 and phasemeter 68 be employed on its own without a servo system controlling the drive motor in the same manner as described above with respect to the block diagram of FIG. 7.

A circuit diagram illustrating the preferred circuit corresponding to block diagram 11 is shown in FIG. 12. As indicated above the vibration sensing means 60 delivers a signal $V_1$ to a band pass filter 62 which comprises high and low pass filters 80 and 81 on the vibration signal line, and the position sensing means 61 delivers a position signal $P_1$ to a pass band filter comprising high and low pass filters 82 and 83 on the position signal line, which band pass filters eliminate high and low frequency parasites as previously mentioned. The construction of low pass filter 80 is identical to that of low pass filter 82 and the construction of high pass filter 81 is identical to that of high pass filter 83. Thus any phase shift inherent in their constructions has no effect on the relative phase difference between the filter signals to be measured.

The amplifiers 84, 85 deliver AC voltage signals to amplifiers 86, 87 respectively via capacitors 84*a* and 85*a*. The (−) terminal of amplifiers 84, 85 is positive or negative depending on the direction of the passage through zero. The amplifiers 86, 87 are Schmidt triggers which deliver a high level output signal only when a positive pulse is delivered by the amplifiers 84, 85 through the aforesaid capacitors 84*a*, 85*a*. The capacitors 86*a*, 87*a* at the output side of amplifiers 86, 87 convert the high level signals into pulses which are supplied to the phasemeter. The phasemeter comprising a bistable device 88 thus receives pulses each time the signals V pass with a positive slope through zero, that is, once during each period of rotation of the roller, the trigger 87 delivers through a capacitor 87*a* a positive pulse to the other input of the bistable device 88 when the eccentric weight is in its position facing the position pick-up.

The bistable device 88 is in its high state when the amplifier 87 delivers a pulse and in its low state when the amplifier 86 delivers a pulse. The periods of these operations are obviously inversely proportional to the vibration frequency and the portion of the period during which the bistable device 88 is in its high state is proportional to the phase angle between the eccentric weight position and the roller movement. The average period value of the output of the bistable 88 thus corresponds to this phase angle.

The output signal from the bistable device 88 then passes through a double filter arrangement 90 and 91 to a follower amplifier 92 in order to adapt the impedences.

A potentiometer 94 permits the setting of the reference phase difference set value. The reference phase value thus set is added to the voltage output of the signal from the follower amplifier 92 in operational amplifier 93 which constitutes the input of operational amplifier 96 which acts as a comparator. The output voltage from the amplifier 93 is also integrated in operational amplifier 95 acting as an integrator. The integrated signal and the compared signal are then added at the input of amplifier 97. It should be noted that instead of the circuit shown in FIG. 12 beyond this point it is possible to employ the corresponding arrangement of the embodiment of FIG. 9.

In the embodiment of FIG. 12 a diode 98 is disposed ahead of amplifier 97 and permits the passage of positive signals only. The output signal from amplifier 97 is delivered to a power amplifier 98 which is connected to a servo valve 99 for controlling the drive motor. As the servo valve 99 is sensitive to cold temperatures a resistor 100 determines the feedback current through the servo valve 99 which thus remains constant throughout operation and therefore irrespective of temperature conditions.

Figure 13:
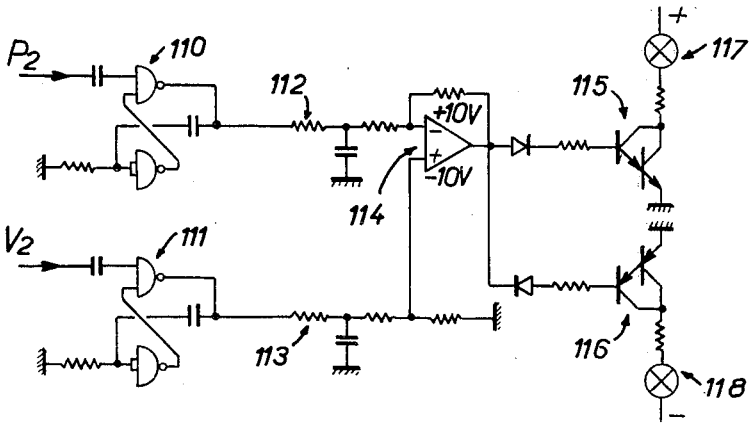
FIG. 13 shows a complementary detection and display circuit for the FIG. 12 circuit for detecting and displaying which of the vibration or position signal frequency is greater.

Means 59 for indicating the frequency error between the vibration and position signals V and P (see FIG. 8) are shown in greater detail in FIG. 13. Such means are likewise adapted to the circuit shown in FIG. 12 and are connected at the leads marked $V_2$ and $P_2$.

As illustrated the circuit of FIG. 13 picks up signals $V_2$ and $P_2$ in FIG. 12 respectively at the outputs of amplifiers 89 and 87. Each signal $V_2$ and $P_2$ is delivered to frequency-meter which is a monostable device 110 providing square wave outputs the periods of which correspond to the frequencies of the respective signals. These square wave signals are smoothed in filters 112 and 113 and compared in operational amplifier 114. If the frequency of signal $P_1$ is greater than the frequency of signal $V_1$ the output signal is applied via power amplifier 115 to light lamp 117, and on the contrary if the frequency of the vibration signal $V_1$ is greater than the frequency of the position signal $P_1$ then the signal is amplified in power amplifier 116 to light lamp 118. Accordingly the operator of the compacting machine is thus given a visual indication of which frequency is greater should this be the case.

The present invention is moreover not limited to the components described herein but is intended to encompass all alternatives, modifications and expedients within the scope of the accompanying claims.

For instance, the vibration pick-up may be an accelerometer. Likewise the position sensor may be a tachometric generator the rotor of which is keyed for rotation with shaft 16. Alternatively, in case shaft 16 is driven by a hydraulic motor, the position sensor may comprise pressure sensing means responsive to the pressure at a predetermined point in the hydraulic circuit supplying the motor.

Finally, the present invention is not confined to roller type vibrating elements as described, but instead may comprise plate type vibrating elements.

What is claimed is:

1. Apparatus for controlling the frequency of vibrations imparted to the ground by a vibrating element of a compacting machine driven by an eccentrically loaded rotary shaft, said apparatus comprising a vibration pick-up responsive to vibrations of the mass composed of said vibrating element and the ground vibrated thereby, said vibration pick-up being rigidly mountable on the body of the compacting machine and comprises a U-shaped magnetic circuit, and an armature of magnetic circuit, a periodic vibration signal being provided at terminals of said coil corresponding to the amplitude of vibrations, position sensing means responsive to the angular position of said rotary shaft and being operable to provide a periodic position signal corresponding to the angular position of said rotary shaft, a phasemeter connected to receive said position and vibration signals and being operable to provide a signal related to the phase difference between the position and vibration signals, and an integrator means for integrating the vibration signal provided by said vibration pick-up before it reaches said phasemeter.

2. Apparatus according to claim 1, wherein said intermediate portion of said magnetic circuit comprises a stack of mild iron discs, and leg portions of said U-shaped magnetic circuit comprise permanent magnets.

3. Apparatus according to claim 1, wherein said vibration pick-up comprises an accelerometer.

4. Apparatus according to claim 1, wherein said position sensing means comprises a proximity sensor responsive to the movement of a marker member fixed for rotation with said shaft.

5. Apparatus according to claim 1, said shaft being driven by a hydraulic motor, wherein said position sensing means comprises a pressure sensor responsive to pressure at a point in a hydraulic supply circuit for said motor.

6. Apparatus according to claim 1, together with a manually controllable motor for driving said rotary shaft, and further including means for displaying the phase difference measured by said phasemeter.

7. Apparatus for controlling the frequency of vibrations imparted to the ground by a vibrating element of a compacting machine driven by an eccentrically loaded rotary shaft, said apparatus comprising a vibration pick-up responsive to vibrations of the mass composed of said vibrating element and the ground vibrated thereby, said vibration pick-up being rigidly mountable on the body of the compacting machine and comprises a U-shaped magnetic circuit, a coil wound on an intermediate portion of said U-shaped magnetic circuit, and an armature of magnetic material carried by said vibrating element facing free ends of said U-shaped magnetic circuit, a periodic vibration signal being provided at terminals of said coil corresponding to the amplitude of vibrations, position sensing means responsive to the angular position of said rotary shaft and being operable to provide a periodic position signal corresponding to the angular position of said rotary shaft, and a phasemeter connected to receive said position and vibration signals and being operable to provide a signal related to the phase difference between the position and vibration signals, said position sensing means comprising a tachometric generator having a rotor keyed for rotation with said shaft.

8. Apparatus for controlling the frequency of vibrations imparted to the ground by a vibrating element of a compacting machine driven by an eccentrically loaded rotary shaft, said apparatus comprising a vibration pick-up responsive to vibrations of a mass composed of said vibrating element and ground vibrated thereby and being operable to provide a periodic vibration signal corresponding to the amplitude of the vibrations, a position pick-up responsive to the angular position of said rotary shaft and being operable to provide a periodic position signal corresponding to the angular position of said rotary shaft, said vibration pick-up and said position pick-up being of similar construction so as to provide respective position signals and vibration signals of the same nature, identical band pass filters connected to the outputs of said vibration pick-up and position pick-up for eliminating high and low frequency parasites, said band pass filters being connected to a phasemeter operable to provide an output signal related to the phase difference between the position and vibration signals.

9. Apparatus according to claim 1, and an automatically controllable motor for driving said rotary shaft, an automatic control circuit for controlling a control member for said motor including a comparator operable to receive an input signal from said phasemeter related to the phase difference between the vibration and position signals and a set signal, said comparator being operable to provide an error signal related to the difference between its input signals.

10. Apparatus according to claim 9, further comprising integrating means for the error signal and means for adding the error signal to the integrated error signal with or without a weighting factor before being received by said control member for said motor.

11. Apparatus according to claim 1 or 9, further comprising frequency error sensing means receiving the vibration signal and the position signal applied to said phasemeter.

12. Apparatus according to claim 1 or 9, comprising pulse shapers for shaping the signals applied at the inputs of said phasemeter.

13. Apparatus according to claim 12, wherein said pulse shapers comprise Schmidt triggers.

14. Apparatus according to claim 1 or 9, further comprising a circuit for detecting whether one of the vibration signal frequency and the position signal frequency is greater than the other, said circuit being connected to pick up signals supplied to said phasemeter and comprising a monostable in each line connected to inputs of a comparator, the output of said comparator being connected to lamps, means for supplying current to one of the lamps in response to a signal furnished by said comparator indicating one of said frequencies is greater than the other.

15. Apparatus according to claim 9, wherein said vibration pick-up comprises a U-shaped magnetic circuit, a coil wound on an intermediate portion of said U-shaped magnetic circuit and an armature of magnetic material carried by said vibrating element facing free ends of said U-shaped magnetic circuit.

16. Apparatus according to claim 15, wherein said position sensing means comprises a U-shaped magnetic circuit, a coil wound on an intermediate portion of said U-shaped magnetic circuit, leg portions of said magnetic circuit being arranged in position sensing relation facing an eccentric disc fixed for rotation with said rotary shaft.

* * * * *